US008677648B2

(12) United States Patent
Schreiner

(10) Patent No.: US 8,677,648 B2
(45) Date of Patent: Mar. 25, 2014

(54) GRAIN AERATION SYSTEM

(75) Inventor: Gary Schreiner, Saskatchewan (CA)

(73) Assignee: Gatco Manufacturing Inc., Saskatoon, Saskatchewan (CA)

( * ) Notice: Subject to any disclaimer, the term of this patent is extended or adjusted under 35 U.S.C. 154(b) by 213 days.

(21) Appl. No.: 12/931,691

(22) Filed: Feb. 8, 2011

(65) Prior Publication Data

US 2011/0219638 A1 Sep. 15, 2011

(30) Foreign Application Priority Data

Mar. 9, 2010 (CA) ..... 2696222

(51) Int. Cl.
*F26B 25/06* (2006.01)

(52) U.S. Cl.
USPC ..... 34/218; 34/219; 34/223; 34/225; 34/230; 34/233

(58) Field of Classification Search
USPC ..... 34/201, 218, 219, 223, 225, 230, 233
See application file for complete search history.

(56) References Cited

U.S. PATENT DOCUMENTS

| | | | | | |
|---|---|---|---|---|---|
| 2,856,838 | A * | 10/1958 | Mack | 454/181 |
| 3,582,046 | A * | 6/1971 | Mueller et al. | 366/106 |
| 3,608,204 | A * | 9/1971 | Ashby | 34/218 |
| 4,009,520 | A * | 3/1977 | Sukup | 34/233 |
| 5,632,674 | A * | 5/1997 | Miller, Jr. | 454/182 |
| 5,851,447 | A * | 12/1998 | Tyer | 261/122.1 |
| 7,818,894 | B2 * | 10/2010 | Noyes et al. | 34/169 |

* cited by examiner

*Primary Examiner* — Kenneth Rinehart
*Assistant Examiner* — Gajanan M Prabhu
(74) *Attorney, Agent, or Firm* — Frank J. Bonini, Jr.; John F. A. Earley, III; Harding, Earley, Follmer & Frailey, P.C.

(57) ABSTRACT

An aeration system for aerating particulate materials disposed in a storage bin is provided. The aeration system comprises a plurality of elongated hollow aerators and a supply conduit connected to each of the plurality of aerators. The supply conduit is connected to a blowing mechanism for receiving air there from and for providing the air to the aerators. Each aerator is disposed inside the storage bin having a substantially vertical orientation and mounted to an inside surface of a wall of the storage bin such that the aerator is structurally supported by the wall. Each aerator has at least an opening for transmitting air from inside the aerator to the particulate materials.

11 Claims, 9 Drawing Sheets

GRAIN AERATION SYSTEM

FIELD OF THE INVENTION

The present invention relates to aeration of particulate materials, and more particularly to an aeration system for aerating particulate materials disposed in a storage bin.

BACKGROUND OF THE INVENTION

After harvest grain such as, for example, wheat, rye, barley, canola, soybeans, is stored in storage bins—on site at a farm or in large commercial storage facilities—prior distribution for processing or sale. Typically, the grain is stored in the storage bins during fall and winter.

Temperature changes due to changing seasons result in an unequal temperature distribution within the grain stored inside the storage bin causing natural convection of air through the grain and causing moisture to migrate therewith. The moisture then gathers in the top portion of the stored grain causing it to spoil. Depending on the temperature and the moisture content of the grain spoilage occurs within weeks or even days.

To prevent spoilage of grain stored in storage bins grain aeration systems or grain drying systems are employed for providing outside air into and through the stored grain. State of the art aeration systems are relatively complex and difficult to install, especially when installed on site as a retrofit to existing storage bins. Furthermore, components of the aeration systems disposed in the bottom portion of the storage bin are prone to damage due to exposure to the weight of the stored grain.

It is desirable to provide an aeration system for aerating particulate materials disposed in a storage bin that is simple and easy to install as a retrofit.

It is also desirable to provide an aeration system for aerating particulate materials disposed in a storage bin that is less likely to be damaged due to exposure to the weight of the stored grain.

SUMMARY OF THE INVENTION

Accordingly, one object of the present invention is to provide an aeration system for aerating particulate materials disposed in a storage bin that is simple and easy to install as a retrofit.

Another object of the present invention is to provide an aeration system for aerating particulate materials disposed in a storage bin that is less likely to be damaged due to exposure to the weight of the stored grain.

According to one aspect of the present invention, there is provided an aeration system for aerating particulate materials disposed in a storage bin. The aeration system comprises a plurality of elongated hollow aerators and a supply conduit connected to each of the plurality of aerators. The supply conduit is connected to a blowing mechanism for receiving air there from and for providing the air to the aerators. Each aerator is disposed inside the storage bin having a substantially vertical orientation and mounted to an inside surface of a wall of the storage bin such that the aerator is structurally supported by the wall. Each aerator has at least an opening for transmitting air from inside the aerator to the particulate materials.

According to another aspect of the present invention, there is provided an aeration system for aerating particulate materials disposed in a storage bin. The aeration system comprises a plurality of elongated hollow aerators and a supply conduit connected to each of the plurality of aerators. The supply conduit is connected to a blowing mechanism for receiving air there from and for providing the air to the aerators. Each aerator is disposed inside the storage bin having a substantially vertical orientation and mounted to an inside surface of a wall of the storage bin such that the aerator is structurally supported by the wall. Each aerator has at least an opening for transmitting air from inside the aerator to the particulate materials. Each of the aerators comprises a back member facing the inside wall of the storage bin and a front member facing the center of the storage bin.

The advantage of the present invention is that it provides an aeration system for aerating particulate materials disposed in a storage bin that is simple and easy to install as a retrofit.

A further advantage of the present invention is that it provides an aeration system for aerating particulate materials disposed in a storage bin that is less likely to be damaged due to exposure to the weight of the stored grain.

BRIEF DESCRIPTION OF THE DRAWINGS

A preferred embodiment of the present invention is described below with reference to the accompanying drawings, in which.

DETAILED DESCRIPTION OF THE PREFERRED EMBODIMENTS

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described.

While the description of the preferred embodiments herein below is with reference to an aeration system for aerating grain disposed in a storage bin, it will become evident to those skilled in the art that the embodiments of the invention are not limited thereto, but are also applicable for aerating numerous other stored particulate materials where a reduction in moisture content and/or a substantially equal temperature distribution within the stored particulate materials is desirable.

Furthermore, while the description of the preferred embodiments herein below is with reference to an aeration system for aerating grain disposed in a storage bin having a circular cross section, it will become evident to those skilled in the art that the embodiments of the invention are not limited thereto, but are also applicable for storage bins having other cross sections such as, for example, cross sections of square or rectangular shape.

Figure 1A:
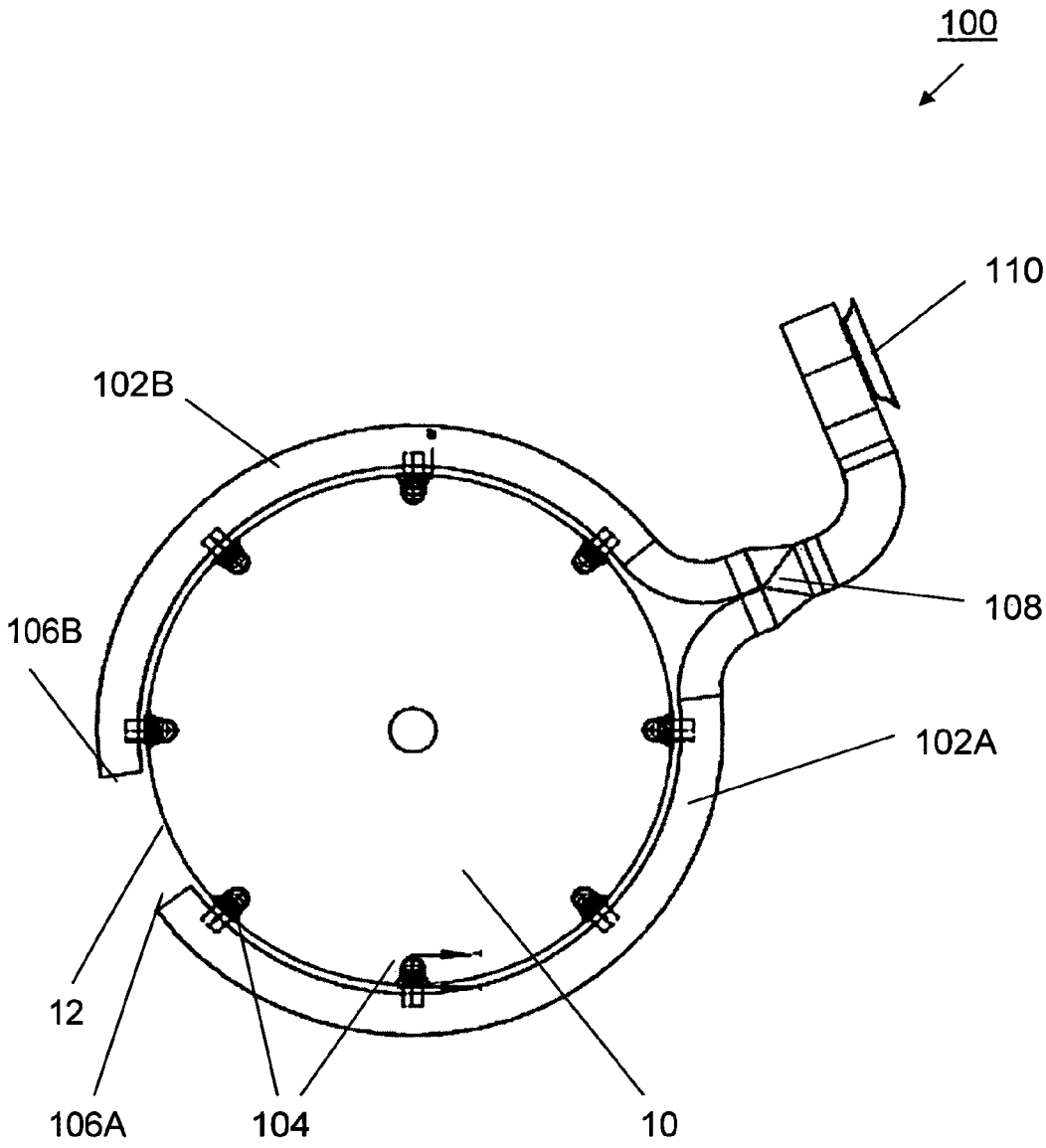
FIGS. 1*a* to 1*c* are a simplified block diagrams illustrating a top view, a cross sectional view, and a perspective view, respectively, of an aeration system according to a preferred embodiment of the invention.
Figure 1B:
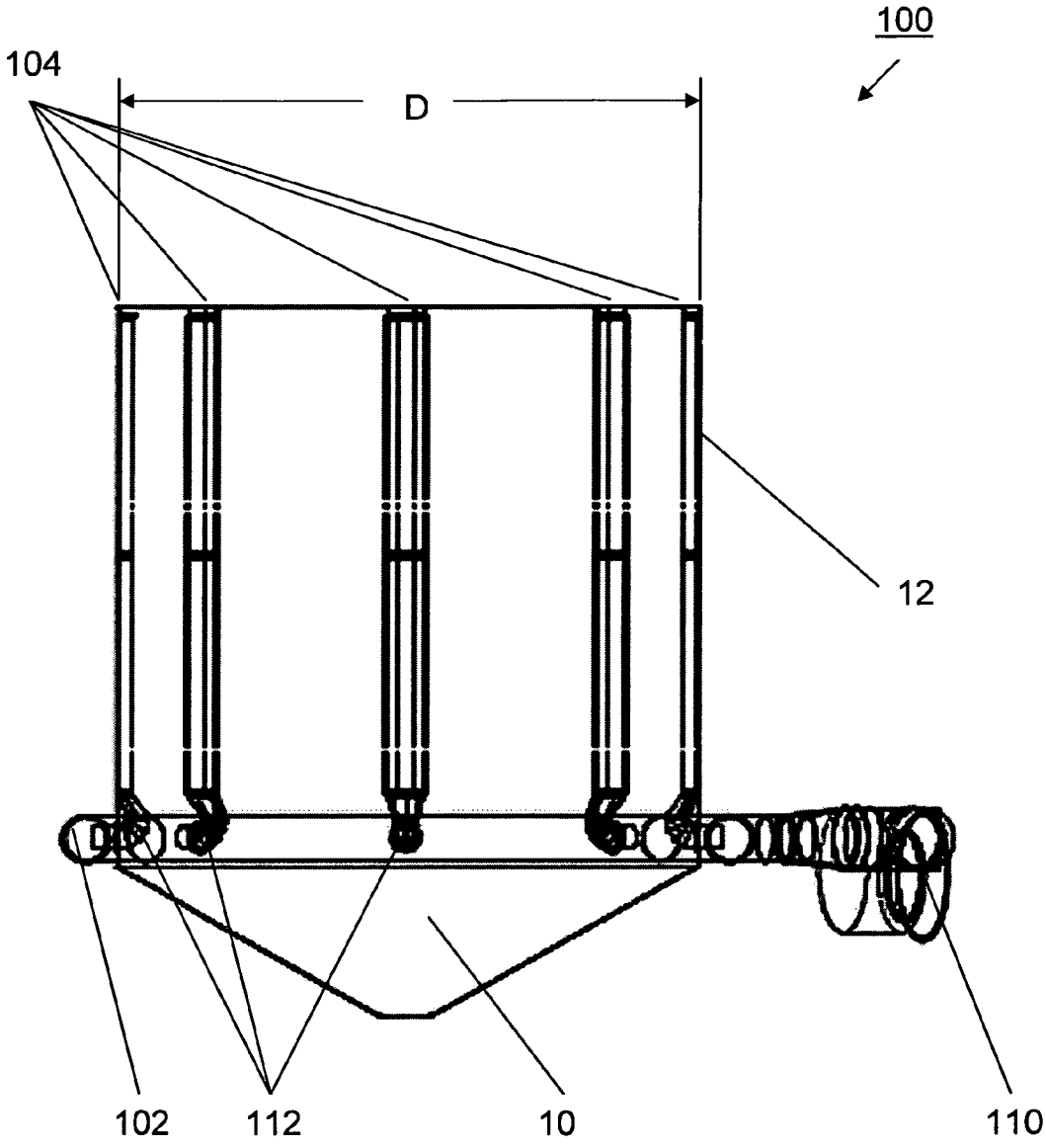
Figure 1C:
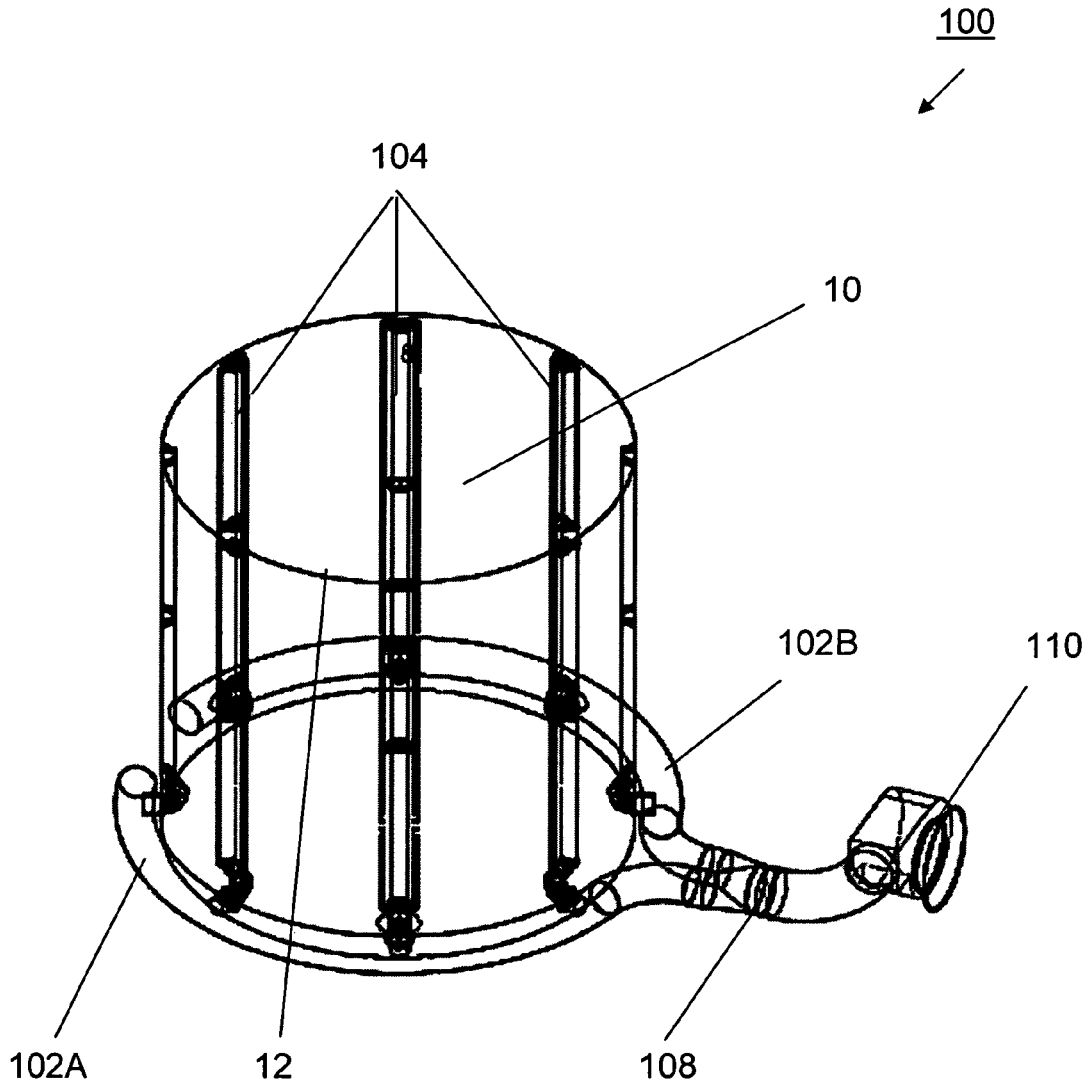

Referring to FIGS. 1*a* to 1*c*, an aeration system 100 for aerating grain disposed in a storage bin 10 according to a preferred embodiment of the invention is provided. The aeration system 100 comprises a plurality of elongated hollow aerators 104 and a supply conduit 102A, 102B connected to the aerators 104. The aerators 104 are mounted to the inside surface of wall 12 of the storage bin 10 such that the aerators 104 are preferably structurally supported by the wall 12. Preferably, the aerators 104 are disposed such that the distance between the aerators 104 is substantially equal to ensure approximately equal aeration of the grain. Each aerator 104 has at least an opening for transmitting air from inside the aerator 104 to the grain as will be described in more detail herein below. A bottom portion of each aerator 104 is connected to the supply conduit 102A, 102B—disposed in proximity to an outside surface of the wall 12 of the storage bin 10—via a respective elbow member 112.

Preferably, the supply conduit comprises a first supply conduit arm 102A having a first portion of the plurality of aerators connected thereto and a second supply conduit arm 102B having a second portion of the plurality of aerators connected thereto. The first supply conduit arm 102A and the second supply conduit arm 102B are connected to the blowing mechanism 110 via connecting element 108. Further preferably, the first supply conduit arm 102A and the second supply conduit arm 102B have an approximately same length and an approximately same number of aerators 104 connected thereto. Provision of the two supply conduit arms 102A and 102B enables a more equal distribution of the air provided by the blower 110 to the aerators 104.

Alternatively, the supply conduit comprises a single supply conduit arm having, for example, a variable cross sectional size which is decreasing with increasing distance to the blowing mechanism.

Optionally, an air conditioning mechanism such as, for example, a heater is interposed in the supply conduit between the blowing mechanism 110 and the connecting member 108.

Preferably, the supply conduit 102A, 102B is manufactured using, for example, commercially available tubing, made of a suitable material such as, for example, sheet metal or plastic material. The connector 108 and end caps 106A, 106B are also commercially available.

The tubing is rigid having a predetermined curvature to fit the curvature of the storage bin 10 or, alternatively, flexible tubing is employed which is bent appropriately to fit the curvature of the storage bin 10. Commercially available elbow members 112 made of a suitable material such as, for example, sheet metal or plastic are employed.

The supply conduit 102A, 102B is, for example, mounted to the outside of the wall 12 of the storage bin 10 using commercially available fasteners. Alternatively, the elbow members 112 are designed to have sufficient strength for supporting the weight of the supply conduit 102A, 102B mounted thereto.

Further alternatively, the supply conduit 102A, 102B is disposed inside the storage bin 10 in proximity of a bottom portion of the wall 12 having, for example, the aerators 104 directly connected thereto, thus omitting employment of the elbow members 112.

Further alternatively, the supply conduit 102A, 102B is disposed at a different location than in proximity to a bottom portion of the storage 10. For example, the supply conduit 102A, 102B is disposed in proximity to a middle portion of the storage bin 10 with aerators 104 being disposed above and below the supply conduit 102A, 102B enabling a more equal provision of the air in situations where the storage bin 10 has a substantially large ratio of height to diameter.

Figure 2A:
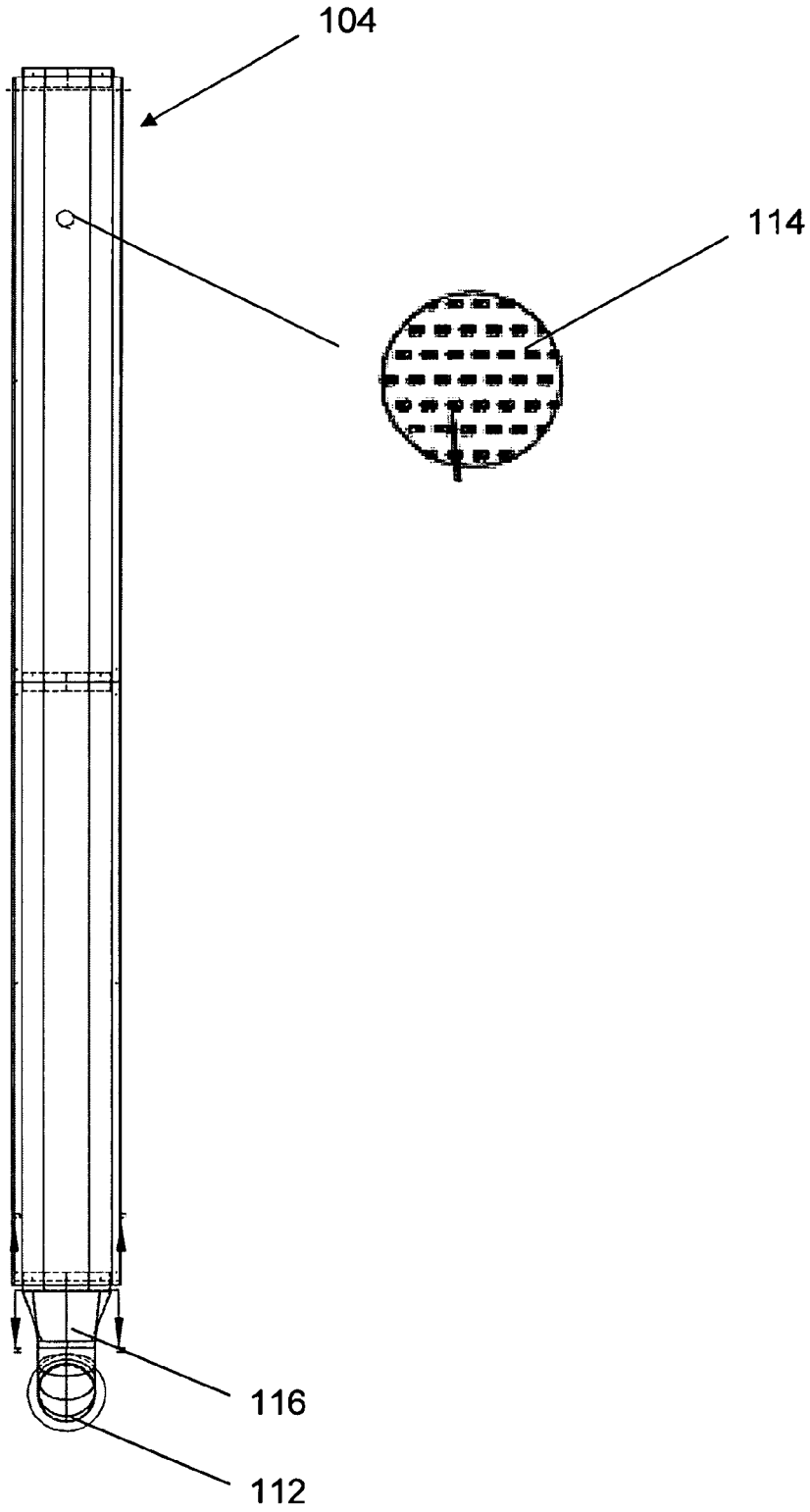
FIGS. 2*a* to 2*e* are a simplified block diagrams illustrating a front view, a side view, a perspective view, a cross sectional view, and an exploded view, respectively, of an aerator of the aeration system according to a preferred embodiment of the invention; and, FIG. 3 is a simplified block diagram illustrating a cross sectional view of an aeration system according to another preferred embodiment of the invention.
Figure 2B:
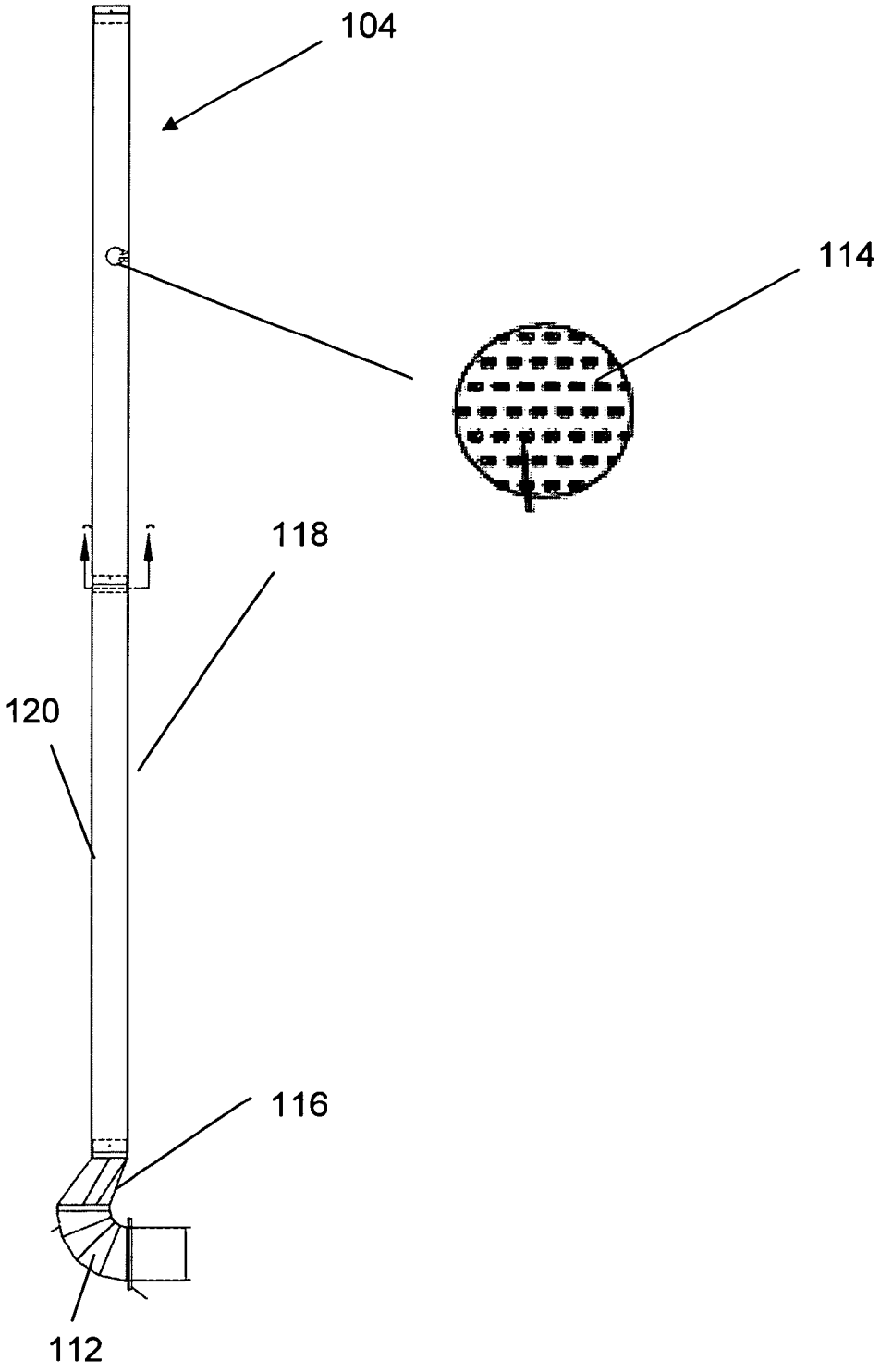
Figure 2C:
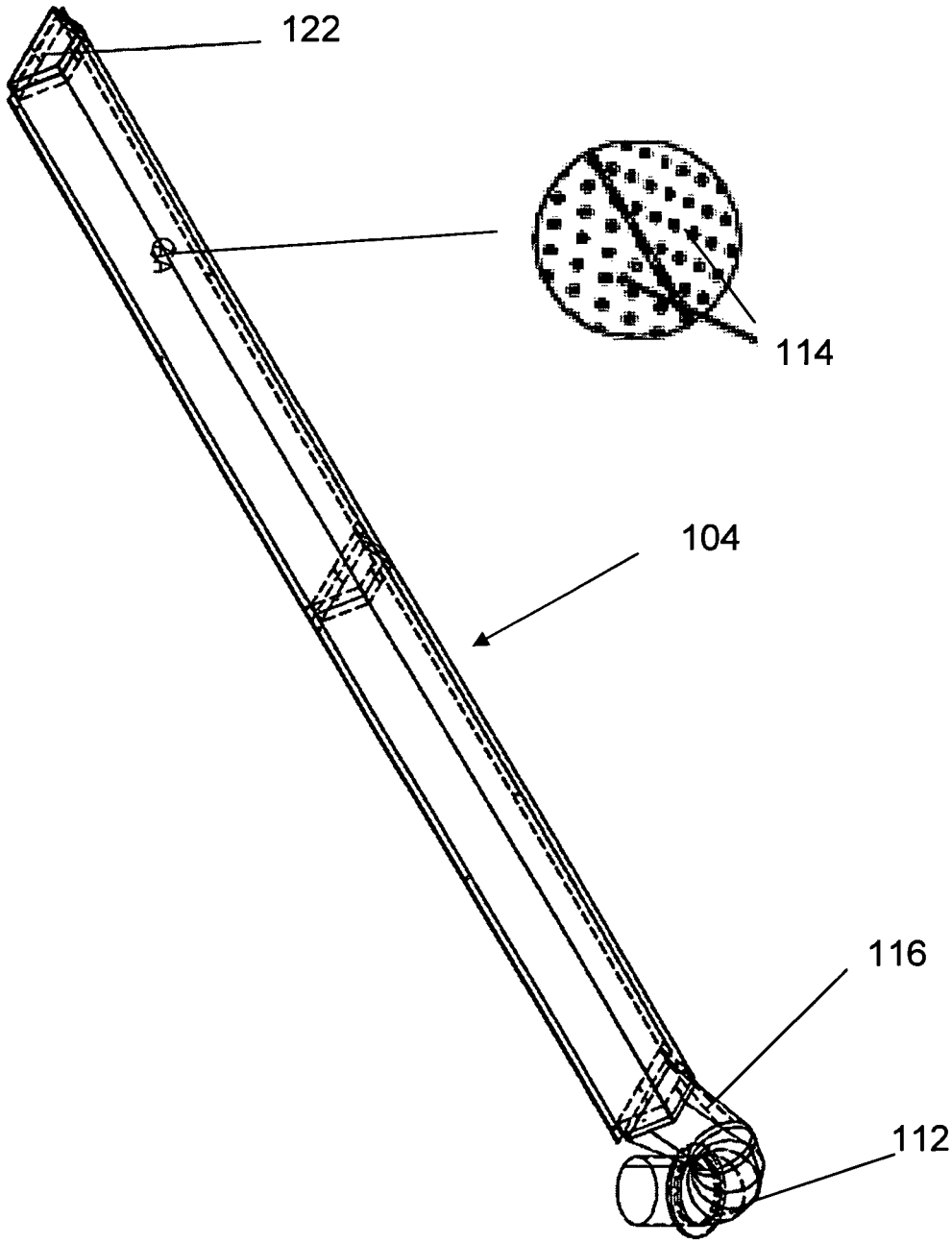
Figure 2D:
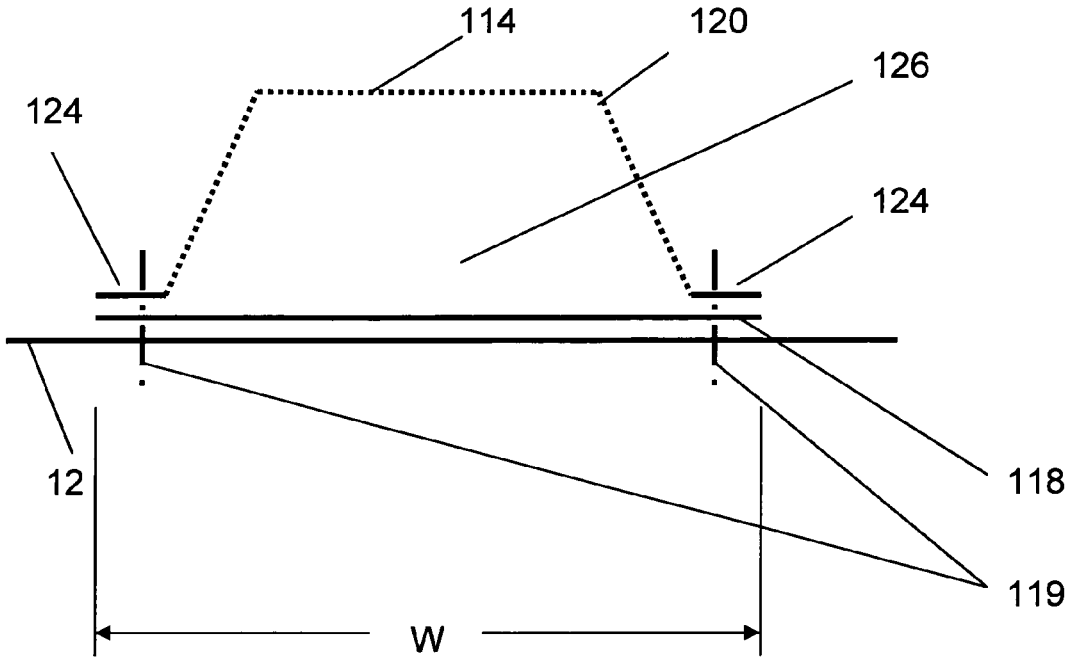
Figure 2E:
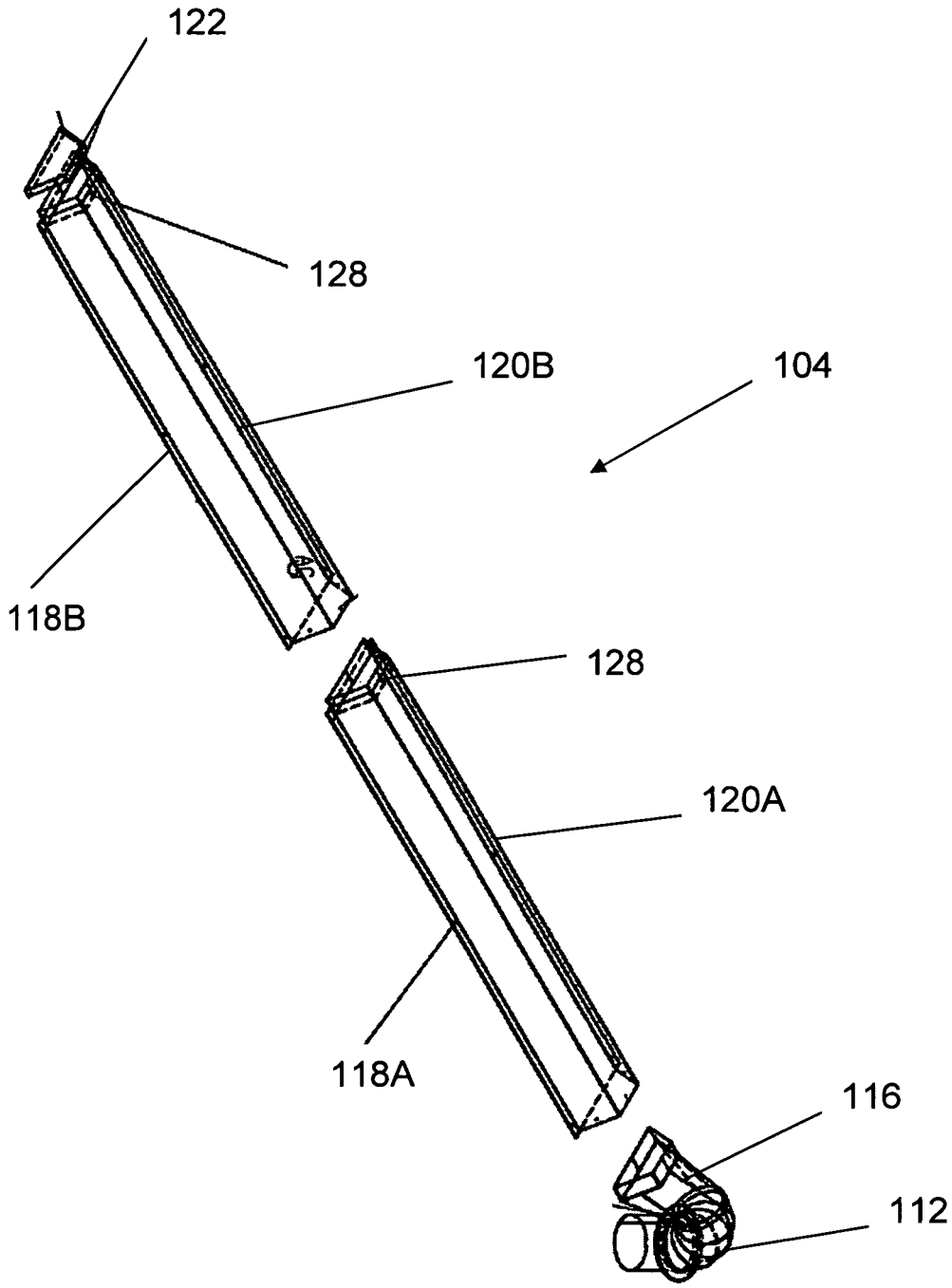

Referring to FIGS. 2*a* to 2*e*, an aerator 104 according to a preferred embodiment of the invention is shown. The aerator 104 comprises a back member 118 facing the inside wall 12 of the storage bin 10 and a front member 120 facing the center of the storage bin 10. The back member 118 is preferably shaped such that a portion of a contact surface of back member 118 is in touching contact with the wall 12 of the storage bin 10 for structural support when mounted thereto. In typical applications, the width W of the contact surface of back member 118 is substantially smaller than the diameter D of the storage bin 10, i.e. provision of a flat contact surface enables sufficient contact area for structural support of the aerator 104 by the wall 12 of the storage bin 10. The back member 118 is mounted to the wall 12 using, for example, sheet metal screws at locations 119, as indicated in FIG. 2*d*, substantially facilitating installation. Optionally, apertures are disposed in the contact surface of the back member 118 at predetermined locations 119 for accommodating the sheet metal screws therein. The front member 120 is mounted to the back member 118 at flanges 124 using, for example, sheet metal screws or a clamping mechanism. Optionally a sealing member is disposed between respective flanges of the back member 118 and the front member 120.

The openings 114 are sized such that airflow from inside 126 the aerator 104 to the particulate materials is enabled while transmission of the particulate materials into the aerator 104 is substantially prevented. Preferably, the aerator 104 comprises openings 114 in the form of round perforations of 1/16 inch diameter disposed on the front member 120—except the flanges 124—with the perforations being positioned at a distance of 1/8 inch (measured center to center) in a staggered pattern, as illustrated in FIGS. 2*a* to 2*d*. The perforations are provided using state of the art manufacturing processes such as standard drilling or laser drilling/cutting. Alternatively, the aerator 104 comprises larger openings disposed on the front member 120 with a screen having perforations of appropriate size. The screen is, for example, made from wire mesh of appropriate dimensions and mounted to the front member 120 using a supporting frame structure. Further alternatively, the perforations are disposed only on the front surface portion or the side surface portions of the front member 120.

Preferably, each of the back member 118 and the front member 120 of the aerator 104 comprises a bottom member 118A, 120A and a top member 118B, 120B in fluid communication with the bottom member. The top and bottom members are mounted together during installation via, for example, joining member 128 of one of the top and bottom members using, for example, sheet metal screws. The joining member is, for example, welded to the one of the top and bottom members. Provision of the top and bottom members facilitates transport and installation, particularly in a retrofit situation. The shorter top and bottom members are more easily moved through a manhole of the storage bin as well as handled inside the storage bin during installation.

The back member 118, the front member 120, the ring member 128, and cap 122 are made of, for example, commercially available sheet metal—appropriate steel or aluminum—or plastic material using standard plastic molding techniques.

Figure 3:
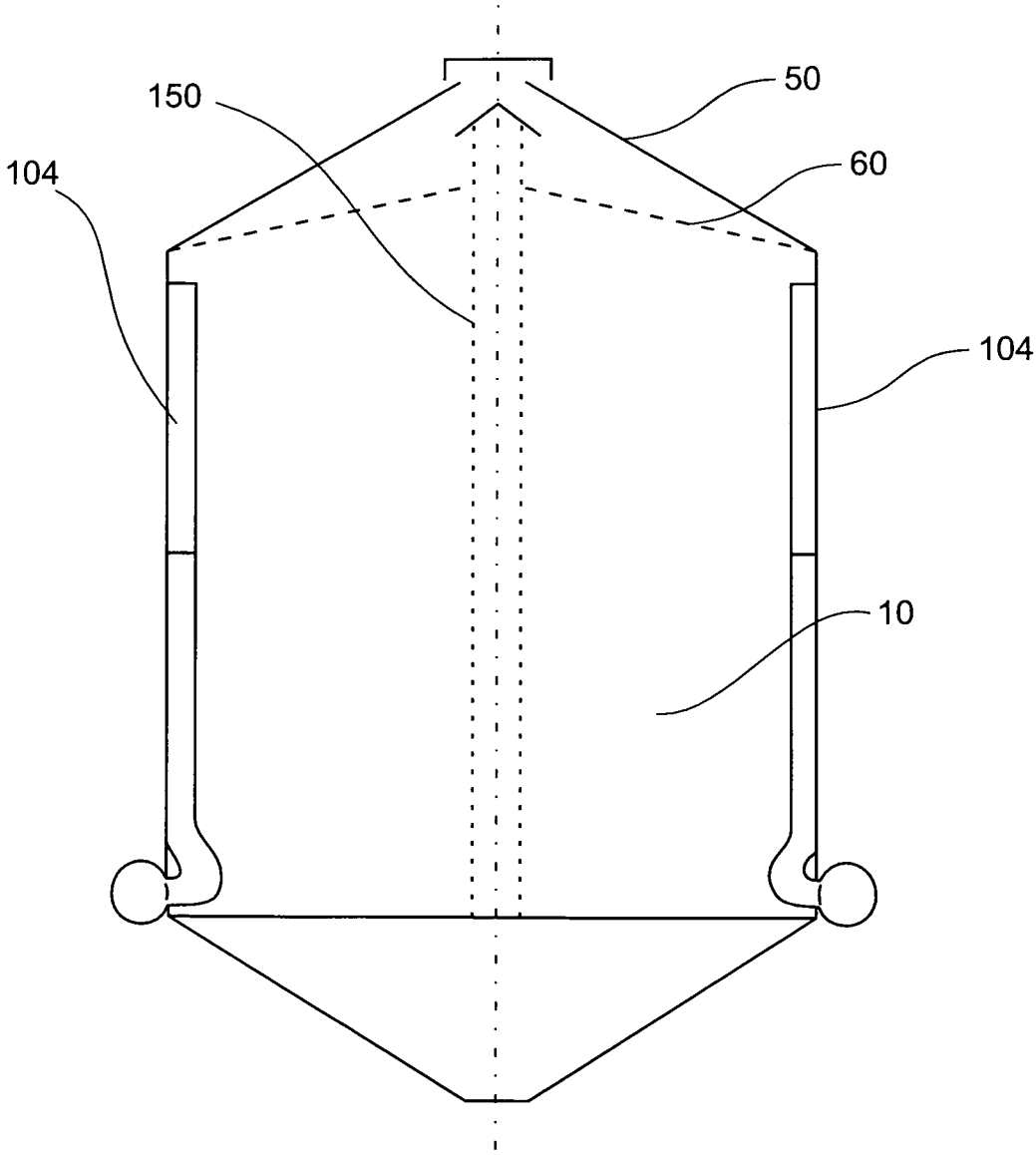

In one embodiment of the present invention, illustrated in FIG. 3, the device of the present invention may be used in combination with an elongated perforated tube 150 securely positioned preferably centrally within the storage bin 10, and extending generally upwardly to the bin roof 50, and vented from the bin roof 50 to a location external the bin 10, to facilitate the aeration of grain 60 disposed in the storage bin 10.

Installation of the aeration system 100 is performed, for example, according to the following steps:

providing apertures at predetermined locations in the bottom portion of the wall 12;

disposing the elbow members 112 in the apertures;

mounting the bottom front member 120A to the bottom back member 118A;

mounting the top front member 120B to the top back member 118B;

mounting the cap 122 to the top front 120B and top back 118B member;

mounting the bottom front member 120A and the bottom back member 118A to the elbow member 112 and to the wall 12;

mounting the top front member 120B and the top back member 118B to the bottom front member 120A and the bottom back member 118A and to the wall 12; and, mounting the supply conduit 102A, 102B to the elbow members 122 and to the storage bin 10.

Alternatively, the aerators 104 comprise a different cross sectional shape than the trapezoidal shape shown in FIG. 2*d* such as, for example, a rectangular shape, hexagonal shape, semi-circular shape or oval shape, but are designed to have sufficient contact with the wall 12 for structural support.

Further alternatively, the aerators 104 are provided as a single unit having flanges suitably placed for mounting the same to the wall 12 such that sufficient contact is provided for structural support. For example, the aerator 104 has a rectangular cross section and flanges extending from the back surface.

Further alternatively, the back member 118 is omitted and the flanges 124 of the front member 120 are directly mounted to the wall 12 of the storage bin 10. Optionally, a seal is disposed between the flange 124 and the wall 12.

The present invention has been described herein with regard to preferred embodiments. However, it will be obvious to persons skilled in the art that a number of variations and modifications can be made without departing from the scope of the invention as described herein.

What is claimed is:

1. An aeration system for aerating particulate materials disposed in a storage bin comprising:

a plurality of elongated hollow aerators, each aerator for being disposed inside the storage bin having a substantially vertical orientation and for being mounted to an inside surface of a wall of the storage bin, each aerator having at least an opening for transmitting air from inside the aerator to the particulate materials;

a supply conduit connected to each of the plurality of aerators, the supply conduit for being connected to a blowing mechanism for receiving air there from and for providing the air to the aerators; and, an elongated perforated tube disposed approximately centrally within the storage bin, the elongated perforated tube extending generally upwardly to the bin roof for being vented from the bin roof to a location external the bin.

2. An aeration system as defined in claim 1 wherein the supply conduit is designed for being disposed in proximity to an outside surface of the storage bin.

3. An aeration system as defined in claim 2 wherein the supply conduit is connected to a bottom portion of each of the aerators.

4. An aeration system as defined in claim 3 wherein each of the aerators is connected to the supply conduit via a respective elbow member.

5. An aeration system as defined in claim 1 wherein each of the aerators is shaped such that a portion of a wall facing side of the aerator is in touching contact with the wall of the storage bin for structural support when mounted thereto.

6. An aeration system as defined in claim 1 wherein the at least an opening comprises a plurality of openings disposed along the aerator such that airflow from inside the aerator to the particulate materials is enabled while transmission of the particulate materials into the aerator is substantially prevented.

7. An aeration system as defined in claim 1 wherein the supply conduit comprises a first supply conduit arm having a first portion of the plurality of aerators connected thereto and a second supply conduit arm having a second portion of the plurality of aerators connected thereto.

8. An aeration system as defined in claim 7 wherein the first supply conduit arm and the second supply conduit arm have an approximately same length and an approximately same number of aerators connected thereto.

9. An aeration system as defined in claim 1 wherein each of the aerators comprises a bottom member and a top member in fluid communication with the bottom member.

10. An aeration system as defined in claim 1 wherein each of the aerators comprises a back member facing the inside wall of the storage bin and a front member facing the center of the storage bin.

11. An aeration system for aerating particulate materials disposed in a storage bin comprising:

a plurality of elongated hollow aerators, each aerator being disposed inside the storage bin having a substantially vertical orientation and being mounted to an inside surface of a wall of the storage bin, each aerator having at least an opening for transmitting air from inside the aerator to the particulate materials;

a blowing mechanism in fluid communication with the plurality of elongated hollow aerators; and, an elongated perforated tube disposed approximately centrally within the storage bin, the elongated perforated tube extending generally upwardly to the bin roof for being vented from the bin roof to a location external the bin.

* * * * *